US007318684B2

(12) United States Patent
Schneider et al.

(10) Patent No.: US 7,318,684 B2
(45) Date of Patent: Jan. 15, 2008

(54) FILE MECHANISM

(76) Inventors: Günter Karl Schneider, Sebastlan-Stöllner-Strasse 27, A-5020 Salzburg (AT); Herbert Damhofer, Georg-von-Nissen-Strasse 59, A-5020 Salzburg (AT)

( * ) Notice: Subject to any disclaimer, the term of this patent is extended or adjusted under 35 U.S.C. 154(b) by 0 days.

(21) Appl. No.: 11/062,525

(22) Filed: Feb. 22, 2005

(65) Prior Publication Data

US 2005/0141952 A1 Jun. 30, 2005

Related U.S. Application Data

(63) Continuation of application No. PCT/AT03/00201, filed on Jul. 17, 2003.

(51) Int. Cl.
*B42F 3/04* (2006.01)
*B42F 13/12* (2006.01)

(52) U.S. Cl. ..... 402/66; 402/35; 402/41; 402/60; 402/69

(58) Field of Classification Search ..... 402/60, 402/66, 69–70, 35, 41; 281/21.1
See application file for complete search history.

(56) References Cited

U.S. PATENT DOCUMENTS

| | | | | |
|---|---|---|---|---|
| 778,910 | A * | 1/1905 | Soennecken | 402/35 |
| 921,931 | A * | 5/1909 | Weizenback | 402/60 |
| 4,830,528 | A * | 5/1989 | Handler | 402/34 |
| 5,511,825 | A * | 4/1996 | Van De Pol | 281/36 |
| 6,637,968 | B2 * | 10/2003 | Ko | 402/41 |
| D509,535 | S * | 9/2005 | Tsujino | D19/32 |
| 2003/0044221 | A1 * | 3/2003 | To et al. | 402/41 |

FOREIGN PATENT DOCUMENTS

| | | |
|---|---|---|
| DE | 4415371 A1 | 5/1994 |
| DE | 29918513 | 10/1999 |
| EP | 0114654 | 1/1984 |
| EP | 0285599 | 3/1988 |
| EP | 0482354 A1 | 9/1991 |
| FR | 2291042 | 11/1974 |
| GB | 150126 | 9/1920 |

* cited by examiner

*Primary Examiner*—Derris H. Banks
*Assistant Examiner*—Eric A. Gates
(74) *Attorney, Agent, or Firm*—Seyfarth Shaw LLP; Thomas M. Saunders

(57) ABSTRACT

This invention concerns a file mechanism for punched documents, comprising a base plate, two mutually spaced filing pins which stand up substantially vertically from the base plate, and a two-limbed transfer arch which is spaced from the filing pins and which is mounted limitedly pivotable between an open and a closed position about a horizontal axis approximately parallel to the base plate and comprises transfer limbs which with their free ends in the closed position contact in pairs the free ends of the filing pins, wherein the transfer limbs are actuable by way of an operating lever which is pivotably mounted to a mounting element projecting from the base plate, characterized in that there is provided at least one reinforcing element which connects the mounting element to the base plate.

20 Claims, 3 Drawing Sheets

FILE MECHANISM

Figure 1:
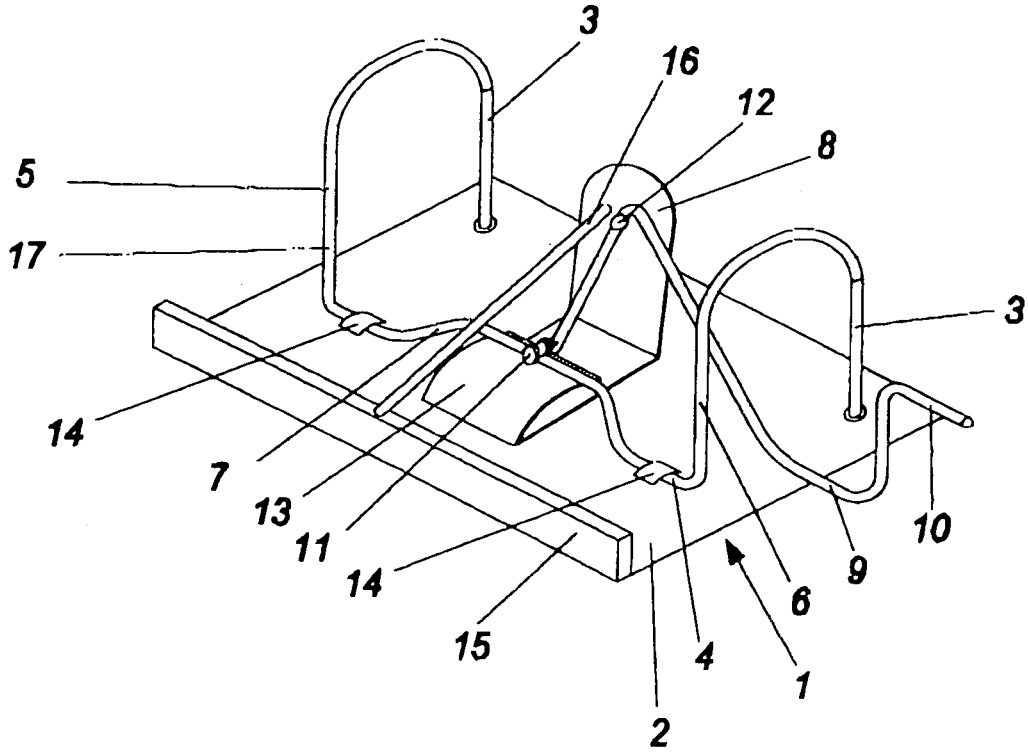

Related Applications:

This application is a continuation of PCT Application No. PCT/AT03/000201, filed Jul. 17, 2003, which claims priority from Austrian Application No: A 1265/2002, filed Aug. 23, 2002, entitled FILE MECHANISM which is incorporated herein by reference.

The present invention relates to a file mechanism for punched documents, comprising a base plate—preferably extending over the complete area—, two mutually spaced filing pins which stand up substantially vertically from the base plate and a two-limbed transfer arch which is spaced from the filing pins and which is mounted limitedly pivotable between an open and a closed position about a horizontal axis which is approximately parallel to the base plate and has transfer limbs which with their fire ends in the closed position contact in pairs the free ends of the filing pins, wherein the transfer limbs arc actuable by way of an operating lever which is pivotably mounted to a mounting element projecting from the base plate.

File mechanisms of that kind have already long been known and are generally intended for letter files comprising a file spine and a front and a back cover each hingedly connected thereto. Thereby the file mechanism is mounted to the hack cover in such a way that in the open position of the transfer arch punched documents can be comfortably fitted in place or removed on the side of the filing pins. For storage in a space-saving fashion the letter files are usually arranged standing side-by-side on shelves so that individual files can be identified by way of their labelled file spines and easily removed from the shelf.

A problem in this connection is that the filing pins must at least partly support the inherent weight of the filed documents, in which case they are only supported at their free ends by way of the contact pressure of the transfer limbs which in turn are fixed by way of the fixing element supported on the mounting element. After prolonged use that results in deflection of the mounting element and bending of the filing pins. That involves the disadvantage that in the closed condition of the transfer arch the free ends of the filing pins and the corresponding transfer limbs no longer contact each other in mutually engaging relationship. That causes considerable difficulty in transferring documents from the filing pins on to the transfer limbs. It is even possible for the filed documents to suffer damage when the pages are turned over.

In an arrangement of the general kind set forth in the preamble of claim 1, the object of the invention is to overcome the above-mentioned problems.

In accordance with the invention that is achieved in that there is provided at least one reinforcing element which connects the mounting element to the base plate. That prevents deflection and yielding of the mounting element, which would result in reduction in the contact pressure force. As the filing pins which are loaded with the weight of the documents are supported at their usually conically tapered free ends by virtue of contact with the free ends of the transfer limbs, which are provided with corresponding recesses, an increase in the contact pressure force in respect of those transfer limbs against the filing pins results in an improvement in stability in regard to flexing of the filing pins. As the transfer limbs are in force-locking relationship in the closed position with the fixing element arranged on the operating lever and the operating lever is mounted to the mounting element which projects from the base plate, the reinforcing element according to the invention provides the desired increase in the contact pressure force with which the transfer limbs are pressed against the filing pins as, in contrast to the state of the art, this involves improved support at the mounting element which now no longer deflects.

An advantageous embodiment of the invention is afforded if the transfer limbs of the transfer arch are connected together by a cranked bar. A bar of that kind can be easily produced for example by a bending operation from a metal wire.

A further advantageous configuration of the invention is afforded if the crank portion of the cranked bar is subjected to the action of a spring force in the opening direction of the transfer arch. That permits easy opening of the transfer arch with entrainment of the documents which have been turned over thereonto, thereby simplifying the placement of new documents on the filing pins.

In an embodiment with a cranked bar, a simple closing mechanism is afforded if the crank portion of the cranked bar can he releasably fixed by a fixing element in opposite relationship to the direction of opening of the transfer arch. Preferably the fixing element is releasable and fixable by the operating lever. Advantageously the fixing element is mounted to or provided at the end of the operating lever, that is adjacent to the cranked bar. It is appropriate for the fixing element to be in the form of a pin which carries a plastic tube or a profiled roller as that reduces the friction between the fixing element and the cranked bar.

A further advantageous embodiment of the invention provides that the operating lever is mounted to the mounting element pivotably about an approximately horizontal axis. That permits easy operation of the, operating lever without being obstructed by the documents in the file.

A further advantageous embodiment of the invention is afforded if the mounting element projects substantially vertically from the base plate and is preferably integrally connected to the base plate. The fact that the mounting element is integral with the base plate permits simple manufacture of the mounting element in the form of a tongue which is bent away from the base plate.

Particularly good reinforcement for the mounting element is afforded if the reinforcing element is connected to the mounting element in the proximity of the mounting location of the operating lever, as the torque exerted by the crank portion acts there. In order for the reinforcing element to be as short as possible it can be provided that it is connected to the base plate in the proximity or the crank portion of the cranked bar.

A further advantageous embodiment of the invention provides that a base element is mounted to or provided at the base plate and the reinforcing element is connected to that support element. In that way it is possible to adjust the steepness of the reinforcing element by way of the height of tile support element.

A particularly simple embodiment of the invention is afforded if the reinforcing element is integral with the base plate. As base plates of that kind are usually stamped out of metal plates, the reinforcing element can be stamped out jointly with the base plate, in the form of an extension which extends away from the base plate, and, alter the mounting element has been arranged on the base plate, the reinforcing element can be bent up and joined to the mounting clement. The reinforcing element can also be produced integrally jointly with the base plate in the case of a base plate which is produced from plastic material In an injection moulding process.

A further advantageous embodiment of the invention provides that the reinforcing element comprises metal. That permits inexpensive manufacture of the reinforcing element insofar as segments of a long metal wire are cut to the desired length.

A further advantageous embodiment of the invention provides that the reinforcing element comprises plastic material. Reinforcing elements of that kind can be produced for example by an injection moulding process and present themselves as an option in the case of a file mechanism which is also made from plastic material.

A further aspect of the invention concerns a tile for punched documents with a file spine and a front and a back cover each hingedly connected to the file spine, wherein arranged on the inside of the back cover is a file mechanism according to the invention as set forth in one of claims 1 to 16. It can also be provided that the individual elements of the file mechanism are to be mounted directly to the inside of the back cover of the file, with the base plate being omitted.

Figure 2A:
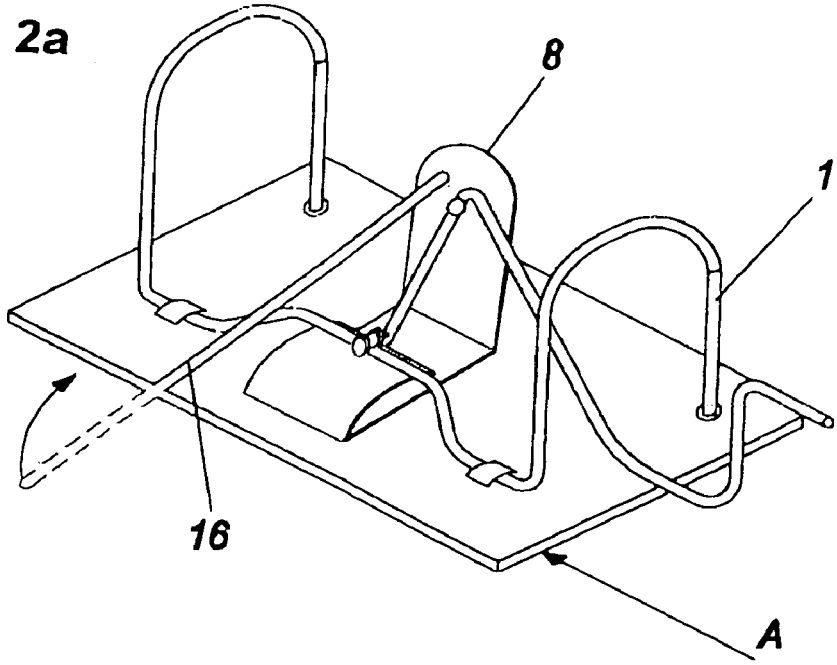
Figure 2B:
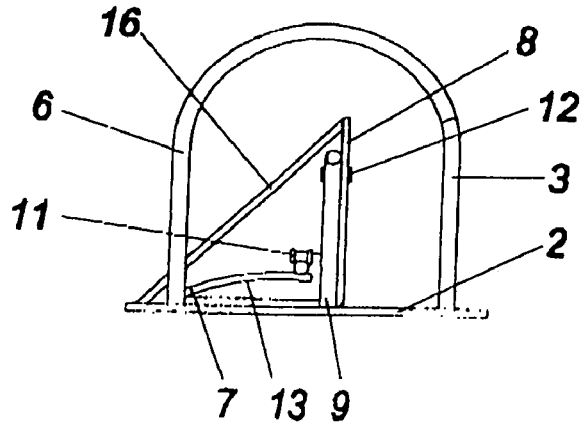
Figure 3:
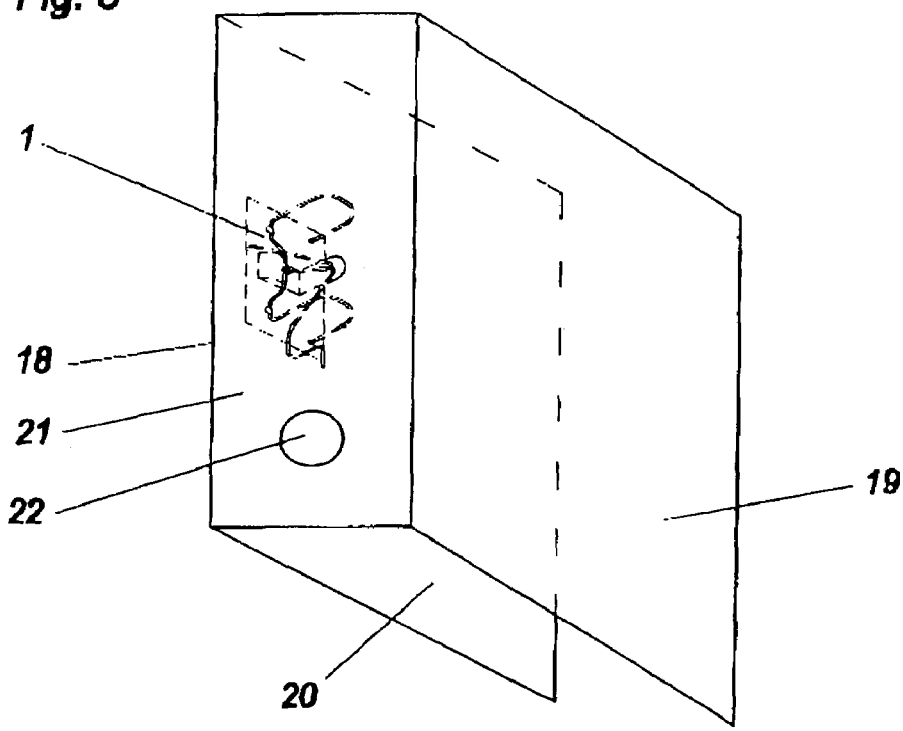
Figure 4:
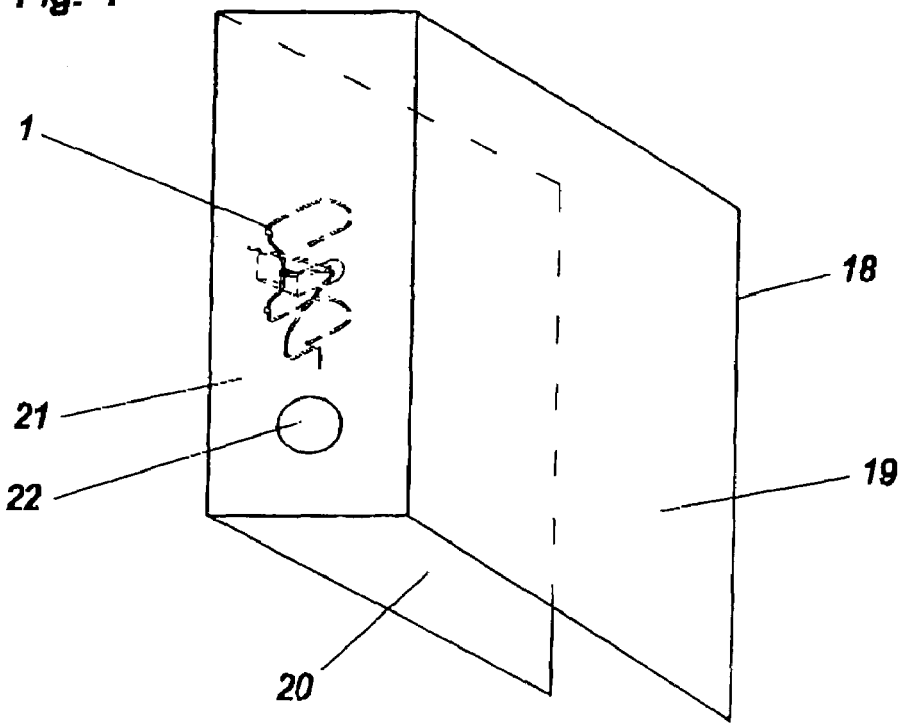

Further details and features of the invention will be apparent from FIGS. 1 to 4 in which:

FIG. 1 is a perspective view of an embodiment of a file mechanism according to the invention, FIGS. 2*a* and 2*b* show a further embodiment of the file mechanism according to the invention as a perspective view and a side view in the direction indicated by A in FIG. 2*a*, FIG. 3 shows a file according to the invention with a file mechanism according to the invention, and FIG. 4 shows a further embodiment of a file according to the invention.

FIG. 1 is a perspective view showing a file mechanism 1 comprising a base plate 2 on which are arranged filing pins 3 which are spaced from each other in an approximately vertical direction. FIG. 1 also shows the transfer arch 17 comprising two transfer limbs 5, 6 which are connected together by way of a cranked bar 4. The cranked bar 4 is mounted by way of tongues 14 which engage over the bar to the base plate 2, pivotably about a horizontal axis parallel to the base plate 2. The crank portion 7 or the bar 4 is subjected to the action of a spring force by way of a spring 13 in the opening direction of the transfer arch 17 and is releasably fixed in opposite relationship to the opening direction of the transfer arch 17 by a fixing element 11 in the form of a pin carrying a profiled roller. The fixing element 11 is mounted to one end of the operating lever 9. The other end 10 of the operating lever 9 is in the form of a gripping element. The operating lever 9 itself is mounted to the mounting element 8 pivotably about a horizontal axis, by way of a mounting location 12. In this embodiment the mounting element 8 is in the form of a mounting plate which is formed integrally with the base plate 2 and which projects approximately vertically from the base plate 2. It will be seen that the reinforcing element 16 according to the invention is connected to the mounting element 8 in tile proximity of the mounting location 12 of the operating lever 9 while tie connection to the base plate 2 is by way of a support element 15 arranged on the base plate 2.

The mode of operation of the file mechanism according to the invention will be described once again by means of the embodiment illustrated in FIG. 1: in order to assume the closed condition of the transfer arch 17 as shown in FIG. 1, the operating lever 9, starting from the open position of the transfer arch 17, is pressed with its free end 10 in tie direction of the base plate 2. Due to the pivotable mounting of the operating lever 9 at the mounting location 12 on the mounting element 8, the other end of the operating lever and the fixing element 11 which is connected thereto and which in this embodiment is in the form of a pin carrying a profiled roller is moved, together with the crank portion 7 of the cranked bar 4, downwardly in the direction of the base plate 2 against the force of the spring element 13 until the fixing element 11 goes beyond the dead centre point into its illustrated closed position. The transfer limbs 5, 6 which are connected to the crank portion 7 by way of the cranked bar 4 are thereby moved in the closing direction and are pressed with their free ends against the free ends of the filing pins 3. The reaction force of the crank portion 7 on the fixing element 11 represents a torque which endeavours to urge the mounting location 12 and therewith the free end of the mounting element 8 away from the crank position 7. That is prevented in accordance with the invention by the reinforcing element 16 which is thereby subjected to a tensile loading. As a result, the energy which is introduced when the operating lever 9 is pressed down is used completely for closing the transfer limbs 5, 6, which increases both the closing force and also the pressure force, which is applied after closure, of the transfer limbs 5, 6 against the free ends of the filing pins 3. Without the reinforcing element 16 a part of that energy would be applied for deforming the mounting element 8 and would thus be lost for the closing movement and applying the contact pressure.

FIG. 2*a* shows a further embodiment or the file mechanism according to the invention, which differs from the embodiment of FIG. 1 by virtue of the configuration of the reinforcing element 16. In the embodiment shown in FIG. 2*a* the reinforcing element 16, in the form of an elongate extension of the base plate. 2 as indicated in broken line, is stamped out jointly with the base plate 2 and then fixed to the mounting element 8. That makes manufacture of a file mechanism 1 according to the invention simpler. FIG. 2*b* shows a side view of the file mechanism 1 of FIG. 2*a* in the direction of the arrow A. Shown at the left in FIG. 2*b* is a transfer limb 6 which is pressed against the filing pin 3 disposed at the right in FIG. 2*b*. It is also possible to see therein the diagonally arranged reinforcing element 16 which is integral with the base plate 2 and fixed to the mounting element 8. The precise nature of the fixing to the mounting element depends on the material used. When using metallic material for the file mechanism 1, for example a solder connection or a rivet connection are possible options. In the case of the file mechanism 1 according to the invention, it would also be possible for the reinforcing element 16 to be produced integrally with the mounting element 8. Equally the reinforcing element 16 could be glued to the mounting element 8. It will be seen that in this embodiment the fixing element 11 is in the form of a pin which is provided with a profiled roller and which is mounted to the operating lever 9. The operating lever 9 is arranged on the mounting element 8 pivotably at the mounting location 12. In FIG. 2*b*, during the closing movement and in the closed condition, the reinforcing element 16 prevents the mounting element 8 from bending towards the right about an axis which points out of the plane of the drawing and which is parallel to the base plate 2 and which extends through the line joining the mounting element 8 to the base plate 2.

FIG. 3 shows a letter file 18 with a file spine 21, a back cover 20 and a front cover 19. The file spine 21 is provided with an engagement hole 22 for easily pulling the file 18 out of a shelf. A file mechanism 1 according to the invention is arranged on the back cover 20.

FIG. 4 also shows a letter file 18 with a file spine 21, a back cover 20 and a front cover 19. As a difference relative to the letter file 18 in FIG. 3, this embodiment does not have the base plate 2 so that the individual elements of the file mechanism 1 are mounted directly to the back cover 20 of the letter file 18.

The invention claimed is:

1. A file mechanism for punched documents, comprising a base plate, two mutually spaced filing pins which stand up substantially vertically from the base plate, and a two-limbed transfer arch which is spaced from the filing pins and which is mounted limitedly pivotable between an open and a closed position about a horizontal axis approximately parallel to the base plate and comprises transfer limbs which with their free ends in the closed position contact in pairs the free ends of the filing pins, wherein the transfer limbs are actuable by way of an operating lever which is pivotably mounted to a mounting element projecting from the base plate, characterised in that there is provided at least one reinforcing element which connects the mounting element to the base plate, wherein said at least one reinforcing element is arranged to prevent bending of said mounting element.

2. A file mechanism according to claim 1 characterised in that the transfer limbs of the transfer arch are connected together by a cranked bar.

3. A file mechanism according to claim 2 characterised in that the cranked bar includes a crank portion which is subjected to the action of a spring force in the opening direction of the transfer arch.

4. A file mechanism according to claim 2 characterised in that the crank portion of the cranked bar can be releasably fixed by a fixing element in opposite relationship to the direction of opening of the transfer arch.

5. A file mechanism according to claim 4 characterised in that the fixing element is releasable and fixable by the operating lever.

6. A file mechanism according to claim 5 characterised in that the fixing element is mounted to or provided at the end of the operating lever, that is adjacent to the cranked bar.

7. A file mechanism according to claim 2 wherein the cranked bar includes a crank portion and the reinforcing element is connected to the base plate in the proximity of the crank portion of the cranked bar.

8. A file mechanism according to claim 1 characterised in that the operating lever is mounted to the mounting element pivotably about an approximately horizontal axis.

9. A file mechanism according to claim 1 characterised in that the mounting element projects substantially vertically from the base plate and is connected to the base plate.

10. A file mechanism according to claim 9 characterised in that the mounting element is integrally connected to the base plate.

11. A file mechanism according to claim 1 wherein the mounting element includes a mounting location of the operating lever characterised in that the reinforcing element is connected to the mounting element in the proximity of the mounting location of the operating lever.

12. A file mechanism according to claim 1 characterised in that a support element is mounted to or provided at the base plate and the reinforcing element is connected to that support element.

13. A file mechanism according to claim 1 characterised in that the reinforcing element is integral with the base plate.

14. A file mechanism according to claim 1 characterised in that it comprises metal.

15. A file mechanism according to claim 1 characterised in that it comprises plastic material.

16. A file mechanism according to claim 1 characterised in that the reinforcing element is a metal wire.

17. A file mechanism according to claim 1 characterised in that the reinforcing element comprises plastic material.

18. A file mechanism according to claim 1 characterised in that the base plate is extending over a surface.

19. A file for punched documents comprising a file spine and a front and a back cover each hingedly connected to the file spine, characterised in that a file mechanism according to claim 1 is arranged on the inside of the back cover.

20. A file comprising a file mechanism for punched documents comprising two mutually spaced filing pins which stand up substantially vertically from the back cover of the file, and a two-limbed transfer arch which is spaced from the filing pins and which is mounted limitedly pivotable between an open and a closed position about a horizontal axis approximately parallel to the back cover of the file and has transfer limbs which with their free ends in the closed position contact in pairs the free ends of the filing pins, wherein the transfer limbs are actuable by way of an operating lever which is pivotably mounted to a mounting element projecting from the back cover of the file, characterised in that there is provided at least one reinforcing element which connects the mounting element to the back cover of the file, wherein said at least one reinforcing element is arranged to prevent bendina of said mounting element.

* * * * *

UNITED STATES PATENT AND TRADEMARK OFFICE

CERTIFICATE OF CORRECTION

PATENT NO. : 7,318,684 B2
APPLICATION NO. : 11/062525
DATED : January 15, 2008
INVENTOR(S) : Schneider et al.

It is certified that error appears in the above-identified patent and that said Letters Patent is hereby corrected as shown below:

On the Title Page Item (60) should read
This application claims priority to -- Austrian Application No. A 1265/2002 filed August 23, 2002 --

Signed and Sealed this

Twenty-seventh Day of May, 2008

JON W. DUDAS
*Director of the United States Patent and Trademark Office*